US010474079B2

(12) United States Patent
Hayashi et al.

(10) Patent No.: US 10,474,079 B2
(45) Date of Patent: Nov. 12, 2019

(54) IMAGE FORMING DEVICE THAT DETECTS A STATE OF AN IMAGE CARRIER

(71) Applicant: KONICA MINOLTA, INC., Chiyoda-ku, Tokyo (JP)

(72) Inventors: Akihiro Hayashi, Okazaki (JP); Yuhei Tatsumoto, Toyokawa (JP); Koji Ohara, Toyokawa (JP); Makoto Shimazoe, Toyokawa (JP); Yasuhiro Koide, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/243,774

(22) Filed: Jan. 9, 2019

(65) Prior Publication Data

US 2019/0227471 A1 Jul. 25, 2019

(30) Foreign Application Priority Data

Jan. 19, 2018 (JP) ..... 2018-006910

(51) Int. Cl.
*G03G 15/00* (2006.01)

(52) U.S. Cl.
CPC ..... *G03G 15/5004* (2013.01); *G03G 15/80* (2013.01)

(58) Field of Classification Search
CPC ..... G03G 15/75; G03G 15/751
USPC ..... 399/26
See application file for complete search history.

(56) References Cited

U.S. PATENT DOCUMENTS 5,278,612 A * 1/1994 Inui ..... G03G 15/75 399/26
6,654,568 B2 * 11/2003 Matsuguma ..... G03G 21/1889 399/26
7,471,906 B2 12/2008 Shima
8,340,536 B2 * 12/2012 Paul et al. ..... G03G 15/75 399/26

FOREIGN PATENT DOCUMENTS

JP 2007171462 A 7/2007
JP 2011028102 A 2/2011

* cited by examiner

*Primary Examiner* — William J Royer
(74) *Attorney, Agent, or Firm* — Holtz, Holtz & Volek PC

(57) ABSTRACT

An image forming device includes: a conductive roller that abuts an image carrier to rotate; a power supply circuit that applies voltage to the roller; a controller that controls the power supply circuit so as to apply the voltage to the roller over a predetermined detection period in a state in which the image carrier and the roller are rotated; a detection value acquirer that acquires a detection value acquired by the application of the voltage indicating a state of the image carrier in the detection period; and a state detector that detects a state of the image carrier on the basis of a plurality of acquired detection values, wherein a length of the detection period is set to a length at which both the numbers of rotations of the image carrier and the roller from a start of the detection period are integers.

8 Claims, 12 Drawing Sheets

IMAGE FORMING DEVICE THAT DETECTS A STATE OF AN IMAGE CARRIER

The entire disclosure of Japanese patent Application No. 2018-006910, filed on Jan. 19, 2018, is incorporated herein by reference in its entirety.

BACKGROUND

Technological Field

The present invention relates to an image forming device.

Description of the Related Art

An electrophotographic image forming device uniformly charges a peripheral surface of a cylindrical photoreceptor and performs light irradiation (pattern exposure) according to image data in a state in which the photoreceptor is stably rotating, thereby partially deleting a charge on the peripheral surface to form a latent image (electrostatic latent image). Then, toner is adhered to the peripheral surface of the photoreceptor and the latent image is visualized as a toner image, and an image is formed on a sheet by transferring the toner image to the sheet.

As the image forming device is used, a photosensitive layer which is a surface layer of the photoreceptor gradually wears. When a film thickness of the photosensitive layer decreases to a lower limit value, the photoreceptor is replaced with a new one. In order to judge the necessity of replacing the photoreceptor, the film thickness of the photosensitive layer is detected.

As the conventional technology for detecting the film thickness of the photosensitive layer, there are technologies disclosed in JP 2011-28102 A and JP 2007-171462 A.

JP 2011-28102 A discloses the technology of eliminating the necessity of a DC current detection circuit only for detecting the film thickness in an AC charging image forming device. In the image forming device disclosed in JP 2011-28102 A, a value of AC current flowing to a charging roller when a plurality of AC voltages having different DC levels is applied to the charging roller in contact with a photoreceptor is detected by an AC current detection circuit. Then, on the basis of a difference between these detection values, that is, on the basis of a DC component of discharge current flowing to the charging roller, the film thickness is detected.

JP 2007-171462 A discloses that, in an AC charging image forming device, when measuring a film thickness on the basis of a DC component of current flowing to a charging roller at the time of charging, an overshoot contained in the DC component is removed by a process in a controller.

The photoreceptor does not always wear uniformly, and there is often a case in which there is a difference in film thickness of the photosensitive layer depending on a position in a circumferential direction. Therefore, in a case of detecting a state of overall wear of the photoreceptor, it is preferable to measure the film thickness at each of a plurality of positions acquired by subdividing an entire periphery of the photoreceptor. For example, it is conceivable that an average value of a plurality of acquired measurement values is used as an index of a progressing state of the overall wear of the photoreceptor.

However, in a case of detecting the film thickness of the photosensitive layer by applying the voltage to the charging roller abutting the photoreceptor as in the technologies in JP 2011-28102 A and JP 2007-171462 A described above, fluctuation of an abutting state of the charging roller problematically affects a detection result of the film thickness of the photosensitive layer. For this reason, reliability of detection of the state of overall wear of the photoreceptor might be reduced conventionally. Especially, in a case where variation of the film thickness of the photosensitive layer is slight, the effect of the fluctuation of the abutting state of the charging roller becomes large and the effect on the detection result of the wear state is great. Causes of the fluctuation in the abutting state of the charging roller include eccentricity of the charging roller, variation in wear of the peripheral surface, partial deformation and contamination of the peripheral surface and the like.

SUMMARY

The present invention is achieved in view of the above-described problems, and an object thereof is to improve reliability of detection of a state of an image carrier performed while a roller abuts.

To achieve the abovementioned object, according to an aspect of the present invention, there is provided an image forming device that forms a latent image on a rotating cylindrical image carrier, and the image forming device reflecting one aspect of the present invention comprises: a conductive roller that abuts the image carrier to rotate; a power supply circuit that applies voltage to the roller, a controller that controls the power supply circuit so as to apply the voltage to the roller over a predetermined detection period in a state in which the image carrier and the roller are rotated; a detection value acquirer that acquires a detection value acquired by the application of the voltage indicating a state of the image carrier every cycle shorter than a time in which the roller rotates once in the detection period; and a state detector that detects a state of the image carrier on the basis of a plurality of acquired detection values, wherein a length of the detection period is set to a length at which both the numbers of rotations of the image carrier and the roller from a start of the detection period are integers.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
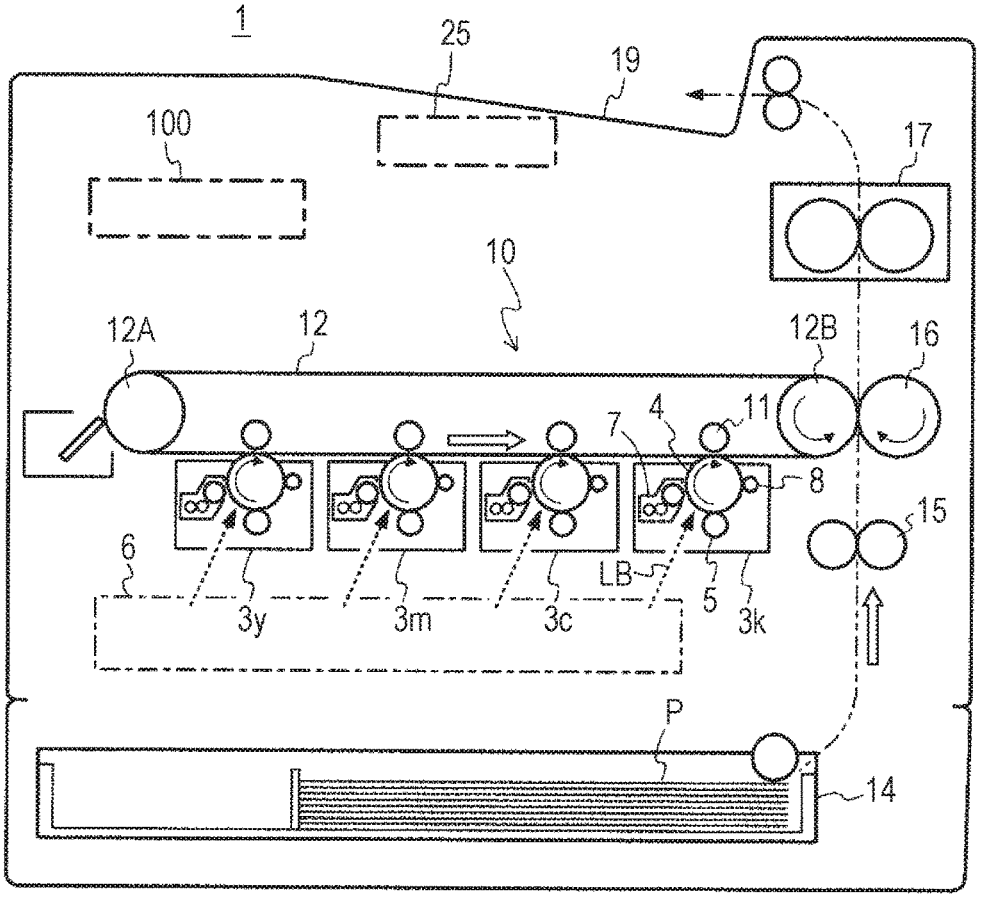
FIG. 1 is a view illustrating an outline of a configuration of an image forming device according to one embodiment of the present invention.
Figure 2:
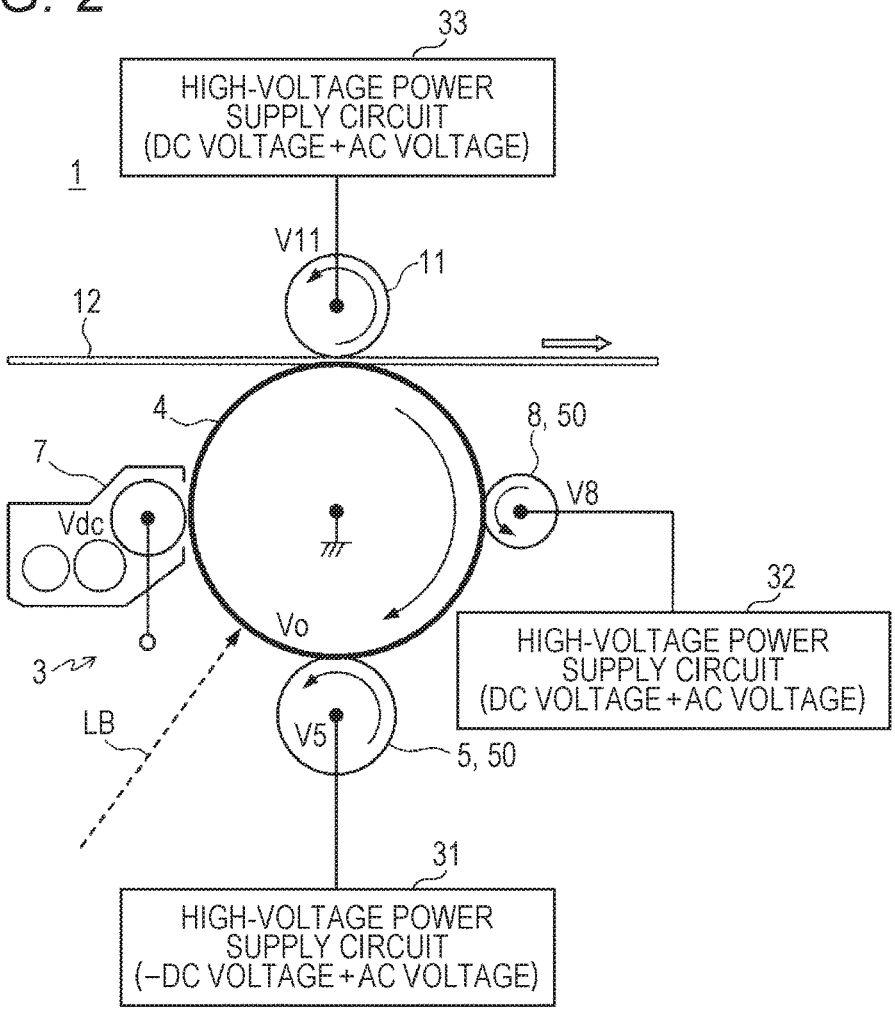
FIG. 2 is a view illustrating a configuration of an imaging unit.
Figure 3:
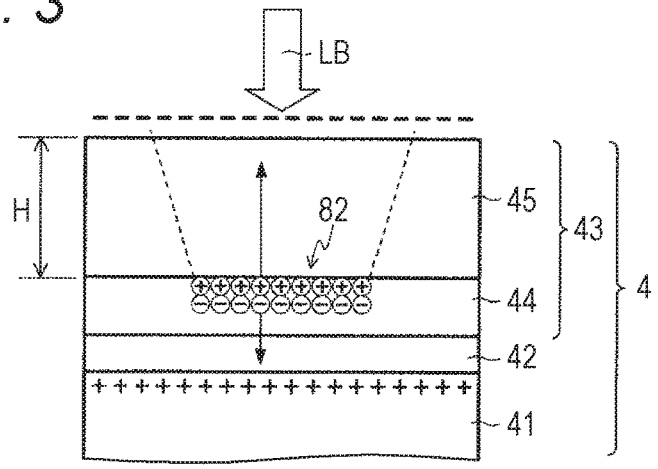
FIG. 3 is a view illustrating an example of a layer structure of a photoreceptor.

FIG. 1 illustrates an outline of a configuration of an image forming device 1 according to one embodiment of the present invention, FIG. 2 illustrates a configuration of an imaging unit 3, and FIG. 3 illustrates an example of a layer structure of a photoreceptor 4.

The image forming device 1 illustrated in FIG. 1 is an electrophotographic color printer provided with a tandem printer engine 10. The image forming device 1 forms a color or monochrome image according to a job input from an external host device via a network. The image forming device 1 includes a control circuit 100 which controls operation thereof. The control circuit 100 is provided with a processor which executes a control program and a peripheral device thereof (ROM, RAM and the like). A display 25 for displaying a state of the image forming device 1 is arranged on a front surface side of an upper part of a housing.

The printer engine 10 includes four imaging units 3*y*, 3*m*, 3*c*, and 3*k*, a print head 6, and an intermediate transfer belt 12.

Each of the imaging units 3*y* to 3*k* includes a cylindrical photoreceptor 4, a charging roller 5, a developer 7, a cleaning roller 8 and the like. Since basic configurations of the imaging units 3*y* to 3*k* are similar, they are hereinafter sometimes referred to as "imaging unit 3" without distinction.

The print head 6 emits a laser beam LB for performing pattern exposure to each of the imaging units 3*y* to 3*k*. Main scanning to deflect the laser beam LB in a rotation axis direction of the photoreceptor 4 is performed in the print head 6. In parallel with this main scanning, sub scanning to rotate the photoreceptor 4 at a constant speed is performed.

The intermediate transfer belt 12 is a member to be transferred in primary transfer of a toner image. The intermediate transfer belt 12 is wound around a pair of rollers 12A and 12B to rotate. A primary transfer roller 11 for applying transfer voltage to each of the imaging units 3*y*, 3*m*, 3*c*, and 3*k* is arranged on an inner side of the intermediate transfer belt 12.

In a color printing mode, the imaging units 3*y* to 3*k* form toner images of four colors of yellow (Y), magenta (M), cyan (C), and black (K) in parallel. The toner images of four colors are sequentially primarily transferred to the rotating intermediate transfer belt 12. First, the toner image of Y is transferred, and the toner image of M, the toner image of C, and the toner image of K are sequentially transferred so as to overlap with the same.

When the primarily transferred toner image is opposed to a secondary transfer roller 16, this is secondarily transferred to a sheet (recording paper) P taken out from a paper feed cassette 14 on a lower side and conveyed through a timing roller 15. Then, after the secondary transfer, the sheet is delivered to a paper discharge tray 19 on an upper side through an inside of a fixer 17. When the sheet passes through the fixer 17, the toner image is fixed to the sheet P by heating and pressurizing.

In FIG. 2, the photoreceptor 4 is an image carrier for forming a latent image and is driven to rotate in one direction integrally with a drum being a supporter.

The charging roller 5 being a contact charging member charges a peripheral surface of the photoreceptor 4 while abutting the photoreceptor 4 to be driven to rotate. It is possible to form a latent image of an image to be printed by performing the pattern exposure on the basis of image data on a uniformly charged portion of the peripheral surface of the photoreceptor 4. A structure, a material, a size and the like of the charging roller 5 may be similar to those conventionally known. The charging roller 5 may be rotationally driven so that a peripheral speed thereof coincides with that of the photoreceptor 4.

The developer 7 adheres the toner to the peripheral surface of the photoreceptor 4 to visualize the latent image as the toner image. For example, the developer 7 mixes the toner with a carrier to stir, thereby charging the same. Then, the charged toner is supplied to a developing position adjacent to the photoreceptor 4.

The cleaning roller 8 abuts the peripheral surface of the photoreceptor 4 after the primary transfer of the toner image is completed and rotates to remove a residual charge.

When forming an image, an AC bias V5 acquired by superimposing AC voltage (Vd) on negative DC voltage (Vc) is applied to the charging roller 5 by a high-voltage power supply circuit 31. That is, charging by a so-called AC charging method is performed. A frequency of the AC voltage is, for example, approximately 500 to 2000 Hz.

A portion on an upstream side of the charging roller 5, that is, a portion moving so as to approach the charging roller 5 out of the surface of the rotating photoreceptor 4 has potential on a relatively positive side with respect to a DC component (Vc) of the AC bias V5. When this portion arrives at the vicinity of an upstream side of a nip portion with the charging roller 5, discharging starts. Since a direction of discharge current alternately switches, the charging becomes uniform. With distance from the nip portion, the discharging weakens and a negative charge corresponding to the DC component (Vc) of the AC bias V5 is eventually applied to the surface of the photoreceptor 4.

In parallel with this, the developer 7 is also biased by negative potential (Vdc), and the toner in the developer 7 carries a negative charge. An output of the high-voltage power supply circuit 31 is adjusted such that surface potential (Vo) of the photoreceptor 4 in the charged state to which the charge is applied is the same as the potential of the toner.

To the primary transfer roller 11, an AC bias V11 acquired by superimposing the AC voltage on positive DC voltage is applied by a high-voltage power supply circuit 33. Also, to the cleaning roller 8, an AC bias V8 acquired by superimposing the AC voltage on the positive DC voltage is applied by a high-voltage power supply circuit 32.

As illustrated in FIG. 3, the photoreceptor 4 is formed of a conductive substrate 41, an undercoat layer 42, and a photosensitive layer 43. Among them, the photosensitive layer 43 has a two-layer structure of a charge generation layer 44 and a charge transport layer 45. Materials of these layers may be known materials.

The conductive substrate 41 is made of aluminum or another metal and supports the undercoat layer 42 and the photosensitive layer 43. The undercoat layer 42 is provided to improve a joining property between the conductive substrate 41 and the photosensitive layer 43 and is made of a resin binder in which conductive particles are dispersed.

The charge generation layer 44 is formed of a resin binder in which charge generation substances such as an azo raw material or a quinone pigment are dispersed. The charge transport layer 45 is formed of a resin binder in which charge transport substances are dispersed. An example of the charge transport substance includes 4,4'-dimethyl-4"-(β-phenylstyryl) triphenylamine. Examples of the resin binder include polycarbonate resin, polystyrene, acrylic resin, methacrylic resin and the like.

When the laser beam LB is applied in a state in which the surface of the photosensitive layer 43 is negatively charged uniformly, a positive charge and a negative charge are generated in an exposure region (photosensitive region) 82 of the charge generation layer 44.

Among the charges generated in the charge generation layer 44, the negative charge moves to the conductive substrate 41 through the undercoat layer 42. On the other hand, the positive charge moves from the charge generation layer 44 to a surface layer of the charge transport layer 45. At that time, the charges spread in a planar direction as they are closer to the surface layer. The charge moving to the surface layer cancels the negative charge on the surface of the photosensitive layer 43. As a result, on the surface of the photosensitive layer 43, a discharged region from which the charge disappears is formed. Thereafter, negatively charged toner adheres to this discharged region, so that the latent image becomes the toner image.

A lifetime of such photoreceptor 4 is a period until a film thickness H thereof reaches a lower limit value by wear of the charge transport layer 45. That is, a film thickness of the charge transport layer 45 is deeply related to the lifetime of the photoreceptor 4, and sizes of the charge generation layer 44, the undercoat layer 42, and the conductive substrate 41 are not directly related to the lifetime of the photoreceptor 4. That is, in this embodiment, the film thickness H of the photoreceptor 4 is substantially the film thickness of the charge transport layer 45.

The image forming device 1 has a state detecting function of detecting the film thickness H as the state of the photoreceptor 4. A detection result of the film thickness H is used, for example, in a notifying process of recommending a user to replace the photoreceptor 4 at the end of the lifetime of the photoreceptor 4. Also, a light amount of the laser beam LB may be adjusted such that an image quality becomes excellent according to the film thickness H.

Hereinafter, the configuration and operation of the image forming device 1 are described focusing on this state detecting function.

When detecting the film thickness H, an AC bias Vm for detection is applied to a conductive roller 50 directly abutting the photoreceptor 4. As the roller 50, the charging roller 5 or the cleaning roller 8 to which the AC bias V5 or V8 is applied at the time of image formation is preferable. This is because there is no need to separately provide a power supply for detection only. However, it is also possible to use other rollers and provide the power supply separately. Also, the roller is not limited to the roller indispensable for image formation, and a dedicated roller 50 used only for detection may also be arranged around the photoreceptor 4.

In a case of using the charging roller 5 as the roller 50, the image forming device 1 is configured as follows.

Figure 4:
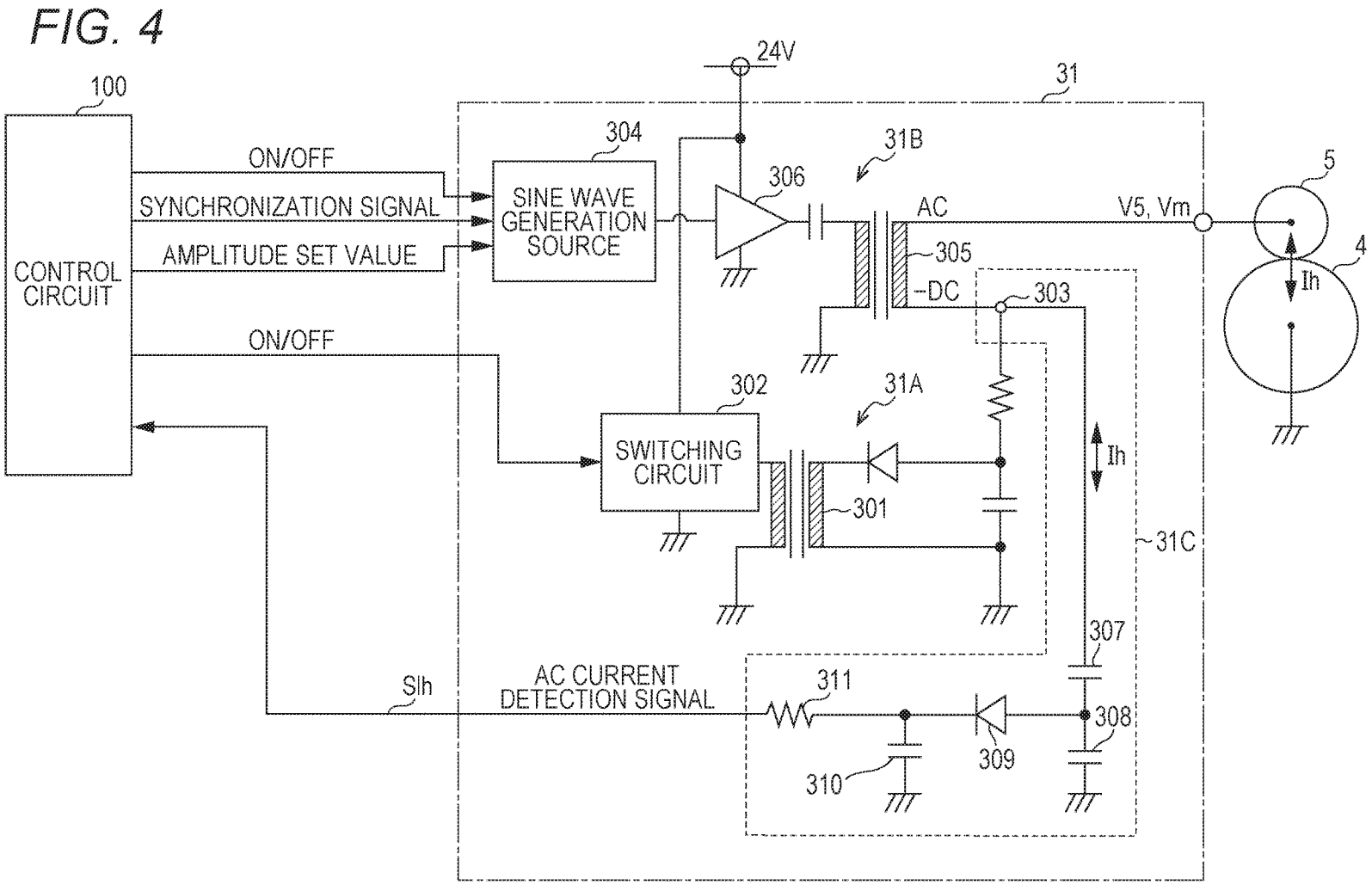
FIG. 4 is a view illustrating an example of a configuration of a high-voltage power supply circuit.
Figure 5:
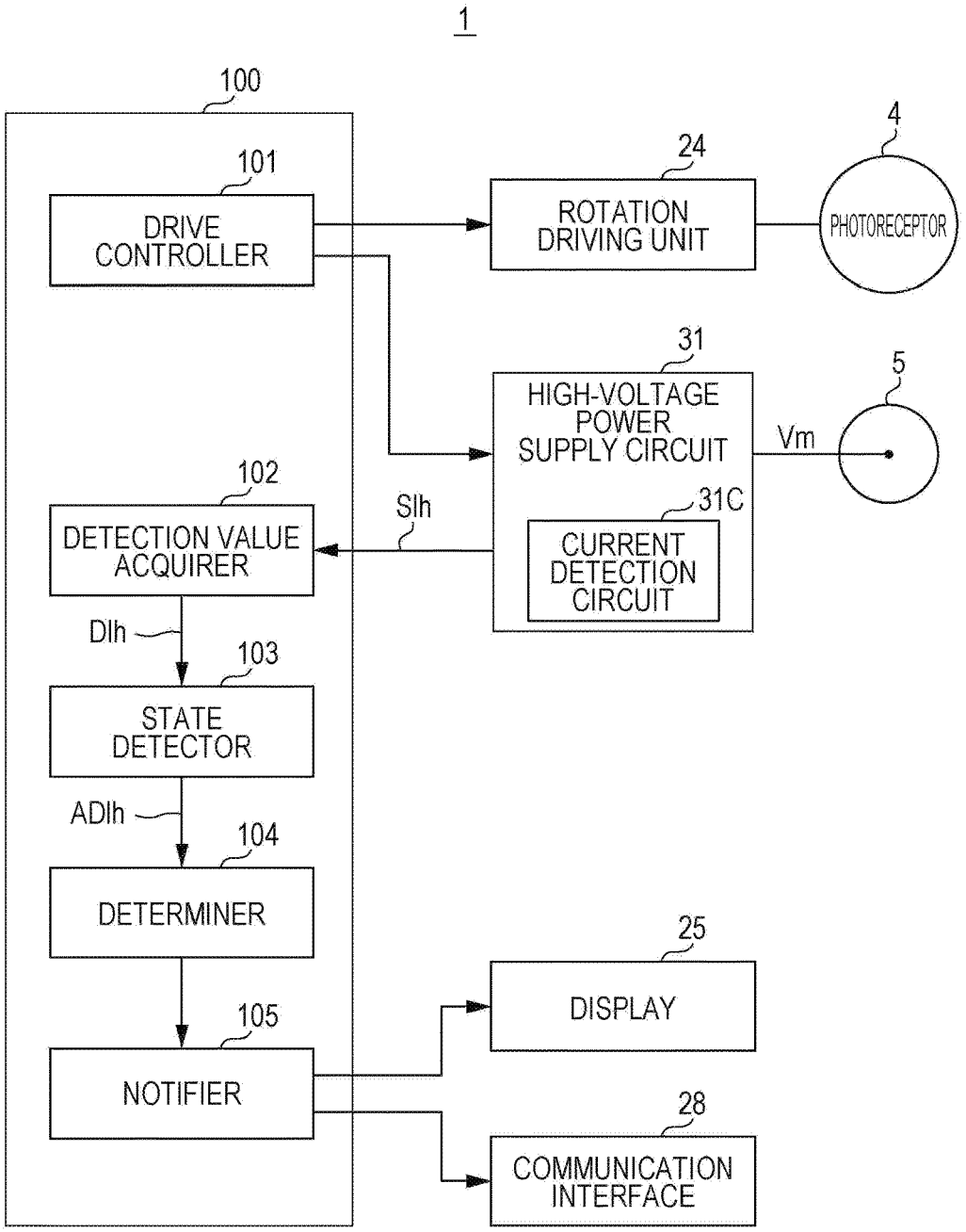
FIG. 5 is a view illustrating a functional configuration of a control circuit.
Figure 6:
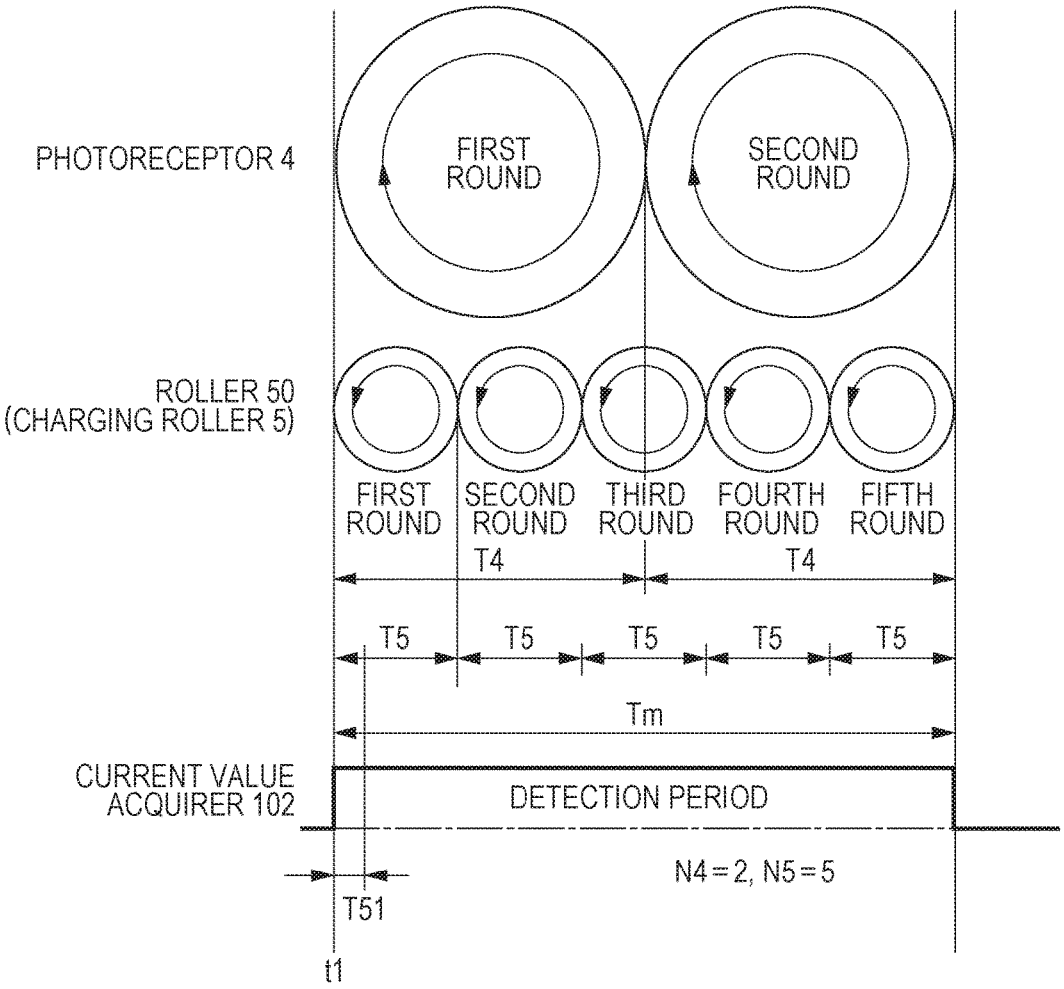
FIG. 6 is a view schematically illustrating a relationship between a detection period for acquiring an AC current value and the numbers of rotations of the photoreceptor and a charging roller.
Figure 7:
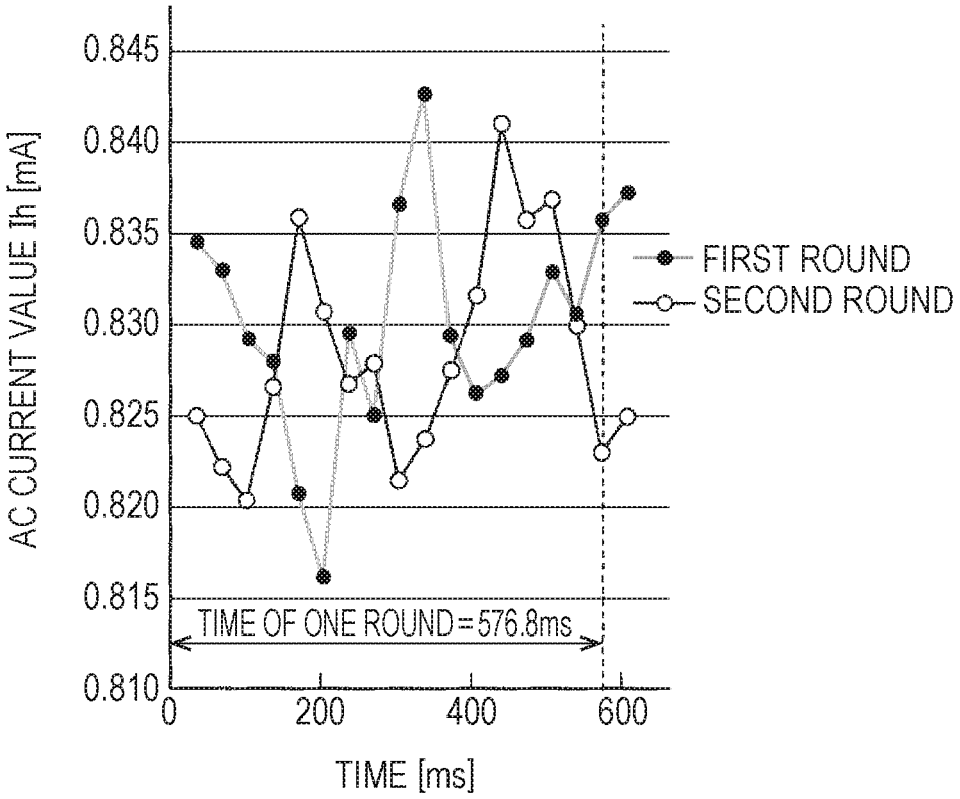
FIG. 7 is a view illustrating an example of fluctuation of an AC current value for detecting a state of the photoreceptor.
Figure 8:
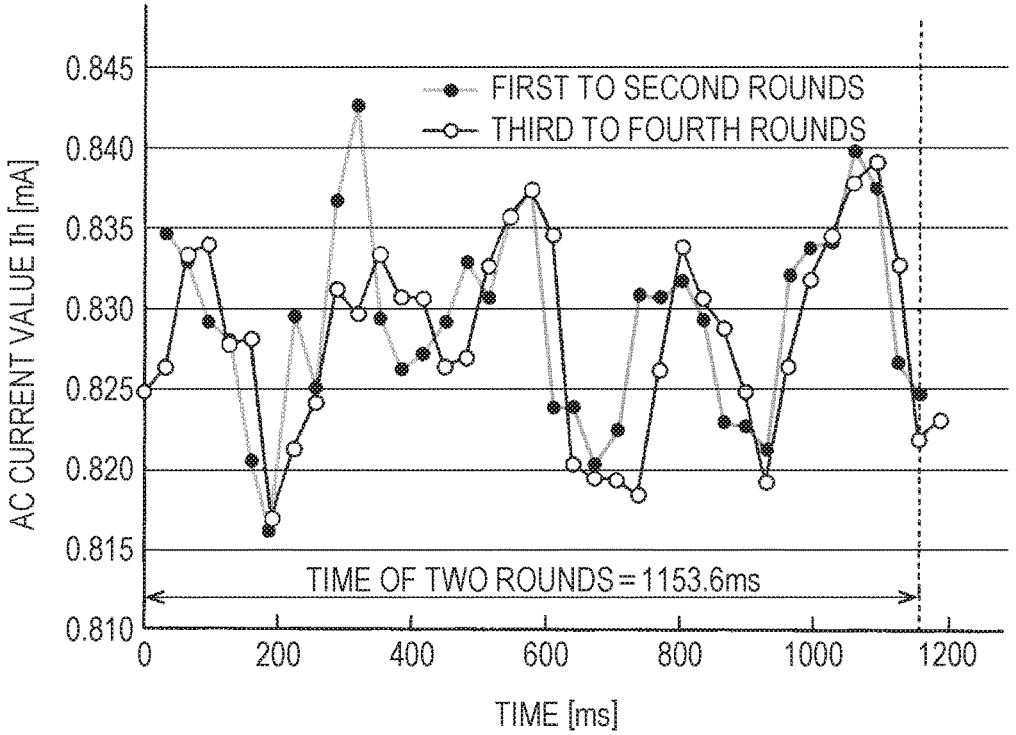
FIG. 8 is a view illustrating an example of fluctuation of the AC current value for detecting the state of the photoreceptor.
Figure 9A:
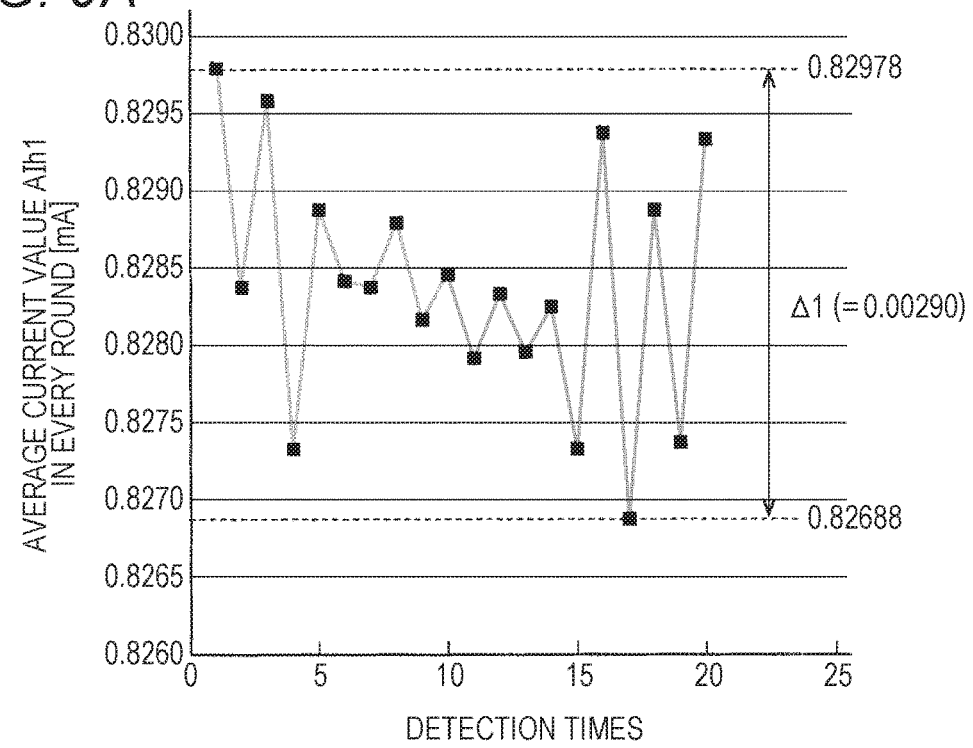
FIGS. 9A and 9B are views illustrating examples of fluctuation of an average current value.
Figure 9B:
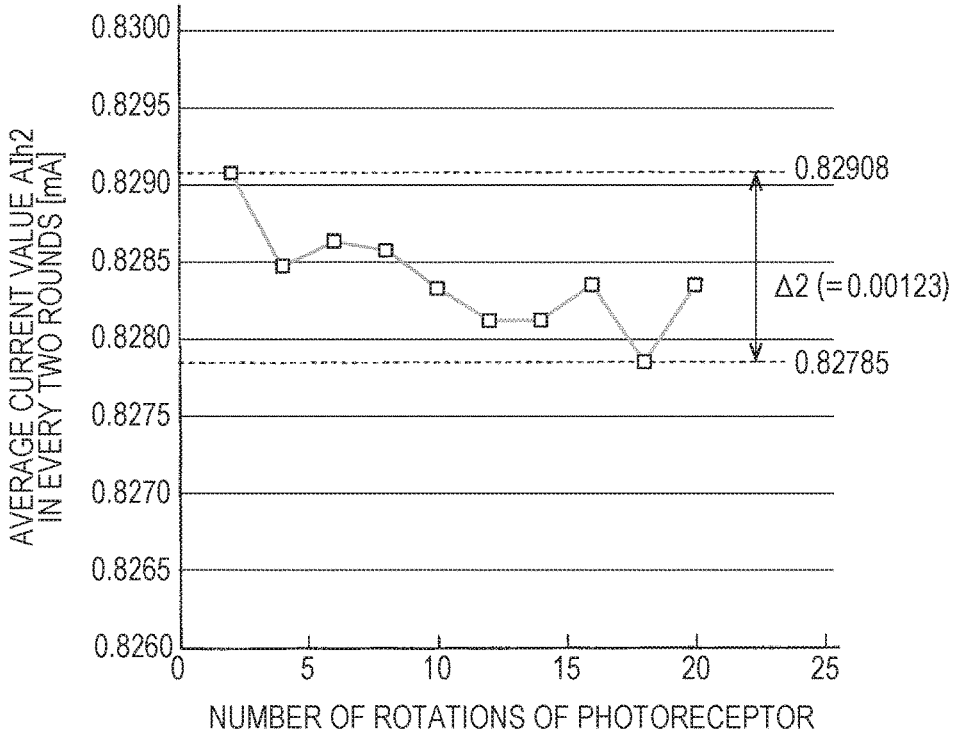

FIG. 4 illustrates an example of a configuration of the high-voltage power supply circuit 31, and FIG. 5 illustrates a functional configuration of the control circuit 100. FIG. 6 schematically illustrates a relationship between a detection period Tm for acquiring an AC current value Ih and numbers of rotations of the photoreceptor 4 and the charging roller 5. Also, FIGS. 7 and 8 illustrate examples of fluctuation of the AC current value Ih for detecting the state of the photoreceptor 4, and FIGS. 9A and 9B illustrate examples of fluctuation of an average current value ADIh.

In FIG. 4, the high-voltage power supply circuit 31 includes a DC power supply unit 31A for boosting DC input voltage to output, an AC power supply unit 31B for amplifying a sine wave signal to output, and an AC current detection circuit 31C for detecting current flowing between the charging roller 5 and the photoreceptor 4.

The DC power supply unit 31A includes a transformer 301, a switching circuit 302 for interrupting current applied to a primary side of the transformer 301 and the like.

The AC power supply unit 31B includes a sine wave generation source 304 which outputs sinusoidal voltage, a transformer 305, an amplifier circuit 306 which amplifies the sinusoidal voltage and applies the same to a primary side of the transformer 305 and the like. One end on a secondary side of the transformer 305 is connected to the charging roller 5, and the other end is connected to a connection terminal 303 to the DC power supply unit 31A. Note that the connection terminal 303 is connected to a non-ground side terminal on a secondary side of the transformer 301 of the DC power supply unit 31A via a resistance and a reverse flow preventing diode.

The sine wave generation source 304 is controlled by the control circuit 100 such that an appropriate AC bias V5 is applied to the charging roller 5 at the time of image formation. At that time, as a method of optimizing the AC bias V5, a well-known method of applying the AC bias V5 of different levels while monitoring an output of the AC current detection circuit 31C to acquire an AC current inflection point at which the discharging starts to determine the AC bias V5 may be used.

The AC current detection circuit 31C is used for setting of the AC bias V5 at the time of image formation and for state detection of the photoreceptor 4 performed other than the time of image formation. The AC current detection circuit 31C includes two capacitors 307 and 308 inserted in series between the connection terminal 303 and a ground line, a diode 309 for half-wave rectification, a smoothing capacitor 310, and an output resistance 311.

The capacitors 307 and 308 serve as a part of a path of the AC current Ih which flows when the AC bias V5 or Vm is applied to the charging roller 5. That is, a closed loop is formed of the capacitors 307 and 308, the transformer 305, the charging roller 5, the photoreceptor 4, and the ground line.

When the AC bias Vm for detecting the state of the photoreceptor 4 is applied to the charging roller 5, the AC current Ih corresponding to the film thickness H of the photosensitive layer 43 flows to this closed loop. Since electrostatic capacitance of the photosensitive layer 43 is smaller as the film thickness H is larger, the AC current Ih when the photoreceptor 4 is new is relatively small. As the photosensitive layer 43 wears and the film thickness H decreases, the electrostatic capacitance increases and the AC current Ih increases.

In addition, when filming occurs in which residual toner or the like spreads in a film shape to adhere to the peripheral surface of the photoreceptor 4, in general, the electrostatic capacitance of the photosensitive layer 43 apparently becomes small and the AC current Ih increases. The AC current Ih strictly depends on the film thickness H of the photosensitive layer 43 and a thickness of deposit.

The AC current detection circuit 31C is configured to rectify and smooth inter-terminal voltage of the capacitor 308 charged and discharged by the flow of the AC current Ih to output as an AC current detection signal SIh. The AC current detection signal SIh is input to the control circuit 100 as a detection signal of the film thickness H, that is, a detection signal of a wear state of the photoreceptor 4. The control circuit 100 acquires a detection value (DIh) of the film thickness H by quantizing the AC current detection signal SIh. Note that the current value of the AC current Ih is hereinafter sometimes referred to as "AC current value Ih".

As illustrated in FIG. 5, the control circuit 100 includes a drive controller 101, a detection value acquirer 102, a state detector 103, a determiner 104, a notifier 105 and the like. These functions are realized by a hardware configuration of the control circuit 100 and by a processor executing a control program.

The drive controller 101 controls a rotation driving unit 24 which drives a plurality of targets to be rotationally driven including the photoreceptor 4 to rotate the photoreceptor 4 and the charging roller 5. At the same time, the drive controller 101 controls the high-voltage power supply circuit 31 so as to apply the AC bias Vm to the charging roller 5 over a predetermined detection period Tm (refer to FIG. 6) to be described later. At that time, amplitude of the AC bias Vm is set to a level at which no discharging occurs between the charging roller 5 and the photoreceptor 4. By preventing the discharging from occurring, a damage of the photoreceptor 4 may be reduced.

In the detection period Tm, the detection value acquirer 102 acquires the AC current value DIh being a detection value indicating the state of the photoreceptor 4 acquired by the application of the AC bias Vm every cycle T51 shorter than a time T5 in which the charging roller 5 rotates once. The AC current value DIh is detection data acquired by quantizing the AC current detection signal SIh.

On the basis of a plurality of acquired AC current values DIh, the state detector 103 detects the state of the photoreceptor 4, that is, the state of wear of the photosensitive layer 43, or a state of coating by the deposit on the peripheral surface of the photoreceptor 4. The state detector 103 calculates the average current value ADIh which is an average value of the plurality of acquired AC current values DIh and notifies the determiner 104 of this as a detection result of the state of the photoreceptor 4.

The determiner 104 determines whether it is necessary to replace the photoreceptor 4 on the basis of the notified average current value ADIh. That is, in a case where the film thickness H corresponding to the average current value ADIh is equal to or smaller than the lower limit value, it is determined that the photoreceptor 4 should be replaced.

Also, the determiner 104 stores the notified average current value ADIh, and in a case where the film thickness H corresponding to a current average current value ADIh is larger than the film thickness H corresponding to a previous average current value ADIh by a predetermined value or more, this judges that at least a part of the peripheral surface of the photoreceptor 4 is covered with the deposit and determines that the photoreceptor 4 should be replaced.

In a case where it is determined that the photoreceptor 4 should be replaced, the notifier 105 allows the display 25 to display this and notifies the user of this. It is also possible to notify an external device connected so as to be able to communicate via a communication interface 28 that the replacement is necessary. As the external device, there are a host (personal computer and the like) which the user uses for inputting the print job, a maintenance management server provided in a service station and the like.

Note that, the photoreceptor 4 hardly wears uniformly over the entire periphery, and in general, there is a slight difference in film thickness H depending on a position in a circumferential direction. Therefore, in order to reduce an effect of wear unevenness in evaluation of the state of wear (film thickness H), the image forming device 1 detects the film thickness H in a plurality of positions in the circumferential direction of the photoreceptor 4. Then, an average value of the plurality of acquired detection values is made an index of a degree of overall wear of the photoreceptor 4.

In this embodiment, the film thickness H in 120 positions acquired by evenly dividing the entire periphery of the photoreceptor 4 is detected. In detail, in a state in which the photoreceptor 4 is rotated at a constant speed and the AC bias Vm is applied to the charging roller 5, the AC current detection signal SIh is quantized in the cycle T51 which is one hundred and twentieth of the time in which the photoreceptor 4 rotates once to acquire the AC current value DIh. In a case where a time T4 in which the photoreceptor 4 rotates once is 576.8 ms, the cycle T51 is approximately 4.8 ms.

In FIG. 6, the detection period Tm for acquiring the AC current value DIh every cycle T51 is an integral multiple of the time T4 in which the photoreceptor 4 rotates once and is also an integral multiple of the time T5 in which the charging roller 5 rotates once. That is, a length of the detection period Tm is the shortest of lengths at which both the number of rotations (N4) of the photoreceptor 4 and the number of rotations (N5) of the charging roller 5 from a start timing t1 of the detection period Tm are integers.

By setting the length of the detection period Tm in this manner, as described hereinafter, an effect of fluctuation of an abutting state of the photoreceptor 4 and the charging roller 5 on the AC current value DIh is reduced and accuracy of the state detection of the photoreceptor 4 increases.

In FIG. 7, the AC current values DIh of a first round and the AC current values DIh of a second round acquired while the photoreceptor 4 rotates twice are indicated by black circles and white circles, respectively. However, these AC current values DIh are not values acquired every cycle T51, but values acquired by averaging seven AC current values DIh acquired in a time period every time period seven times the cycle T51 (approximately 33.6 ms).

Since the AC current value DIh corresponds to the film thickness H, it is understood from FIG. 7 that there is a difference in film thickness H depending on the position in the circumferential direction of the photoreceptor 4. In addition, since a mode of the fluctuation (fluctuation pattern) of the AC current values DIh in time series is totally different between the first and second rounds, it is understood that the fluctuation of the AC current value DIh is caused by a factor other than non-uniformity of the film thickness H. In order to improve the accuracy of the state detection of the photoreceptor 4, it is necessary to reduce the effect of this factor.

In FIG. 8, the AC current values DIh of the first and second rounds and the AC current values DIh of third and fourth rounds acquired while the photoreceptor 4 rotates four times are indicated by black circles and white circles, respectively. However, as in FIG. 7, these AC current values DIh are values acquired by averaging a predetermined number of AC current values DIh.

Comparing FIG. 8 with FIG. 7, it is understood that the mode of the fluctuation of the AC current values DIh of the first and second rounds and the mode of the fluctuation of the AC current values DIh of the third to fourth rounds illustrated in FIG. 8 substantially coincide with each other.

In FIG. 9A, average current values AIh1 acquired by averaging a plurality of AC current values DIh acquired while the photoreceptor 4 rotates 20 times in every round are indicated by black squares, and in FIG. 9B, average current values AIh2 acquired by averaging the plurality of AC current values DIh in every two rounds are indicated by white squares.

In averaging in every round illustrated in FIG. 9A, a difference Δ1 between a maximum value and a minimum value of the average current value AIh1 is 0.00290 mA. On the other hand, in the averaging per two rounds illustrated in FIG. 9B, a difference Δ2 between a maximum value and a minimum value of the average current value AIh2 is 0.00123 mA. That is, variation of the average current values AIh2 in every two rounds is not more than one half of the variation of the average current values AIh1 in every round.

In addition, the variation of the average current values AIh2 in every two rounds is smaller than the variation of average current values AIh3 in every three rounds (Δ3=0.00140 mA).

Therefore, by making a length of the detection period Tm equal to the length of two rotations of the photoreceptor 4, it is possible to acquire the average current value AIh on which the effect of the variation of the AC current values DIh caused by the charging roller 5. According to the average current value AIh, it is possible to more correctly evaluate the state of the photoreceptor 4 and determine necessity of the replacement of the photoreceptor 4.

Figure 10:
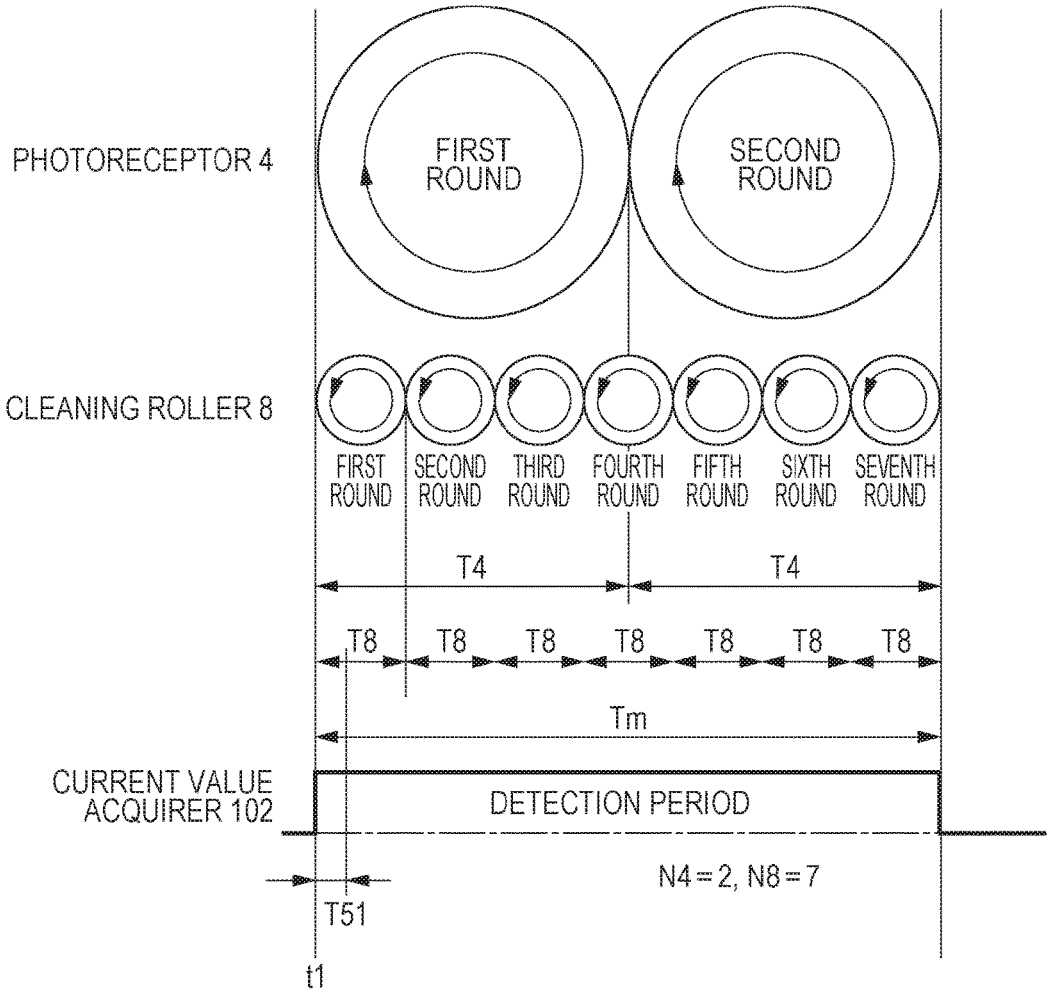
FIG. 10 is a view schematically illustrating a relationship between a detection period for acquiring the AC current value and the numbers of rotations of the photoreceptor and a cleaning roller.

FIG. 10 schematically illustrates a relationship between the detection period Tm for acquiring the AC current value DIh and the numbers of rotations of the photoreceptor 4 and the cleaning roller 8.

In place of the charging roller 5, the cleaning roller 8 may also be used as the roller 50 which applies the AC bias Vm for detecting the state of the photoreceptor 4. In such a case, the drive controller 101 controls the high-voltage power supply circuit 32 in place of the high-voltage power supply circuit 31 as a power supply for applying the AC bias Vm. The high-voltage power supply circuit 32 includes a circuit configured similarly to the AC current detection circuit 31C illustrated in FIG. 4 for outputting the AC current detection signal SIh.

As illustrated, a peripheral length of the photoreceptor 4 is selected to be 3.5 times a peripheral length of the cleaning roller 8. Therefore, the detection period Tm is set to be twice the time T4 in which the photoreceptor 4 rotates once, and also seven times a time T8 in which the cleaning roller 8 rotates once. That is, the length of the detection period Tm is the shortest of lengths at which both the number of rotations (N4) of the photoreceptor 4 and the number of rotations (N8) of the cleaning roller 8 from the start timing t1 of the detection period Tm are integers.

As a result, it is possible to acquire the average current value AIh on which the effect of the variation of the AC current values DIh caused by the cleaning roller 8 is small and improve accuracy of determination whether the photoreceptor 4 should be replaced.

Figure 11:
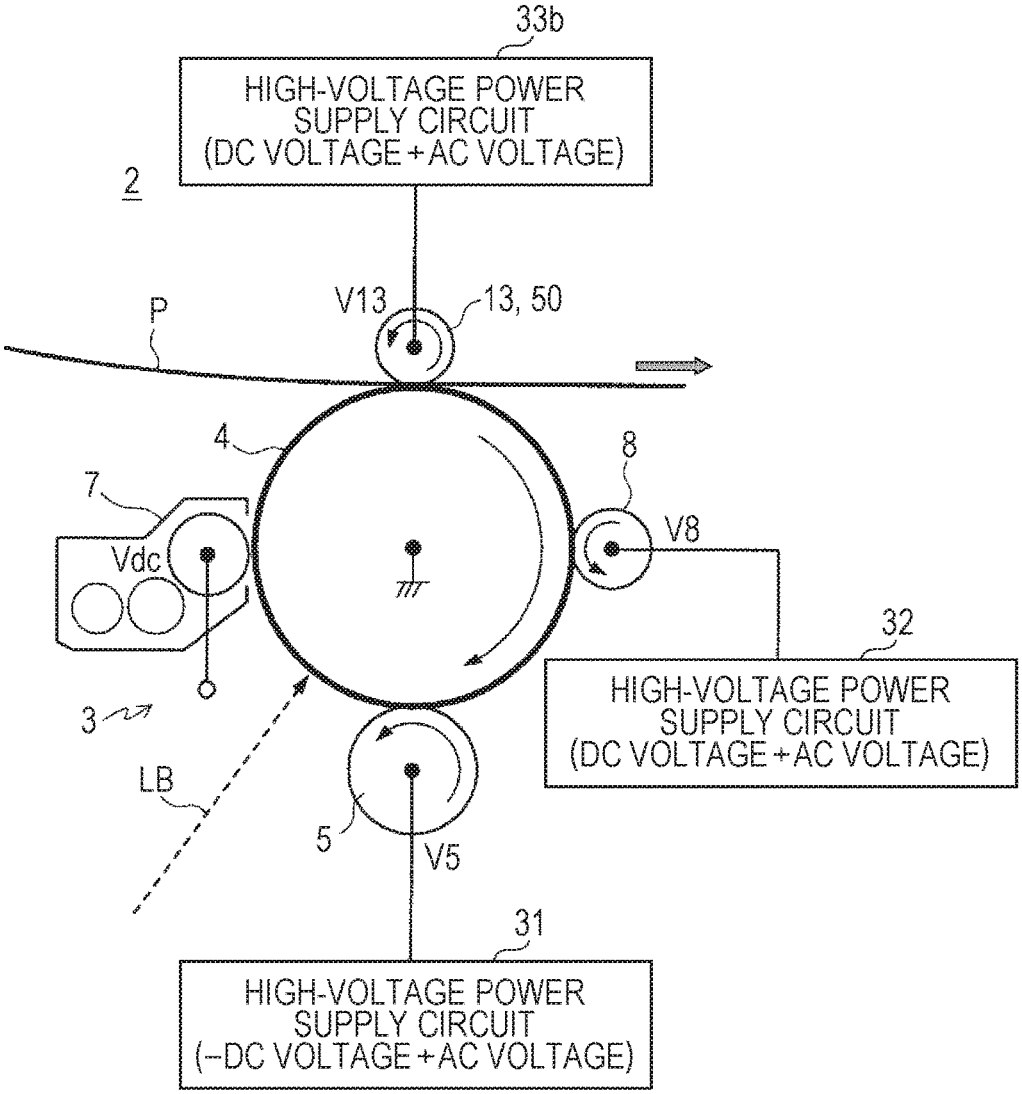
FIG. 11 is a view illustrating an example of a configuration of a peripheral portion of a photoreceptor in another image forming device.
Figure 12:
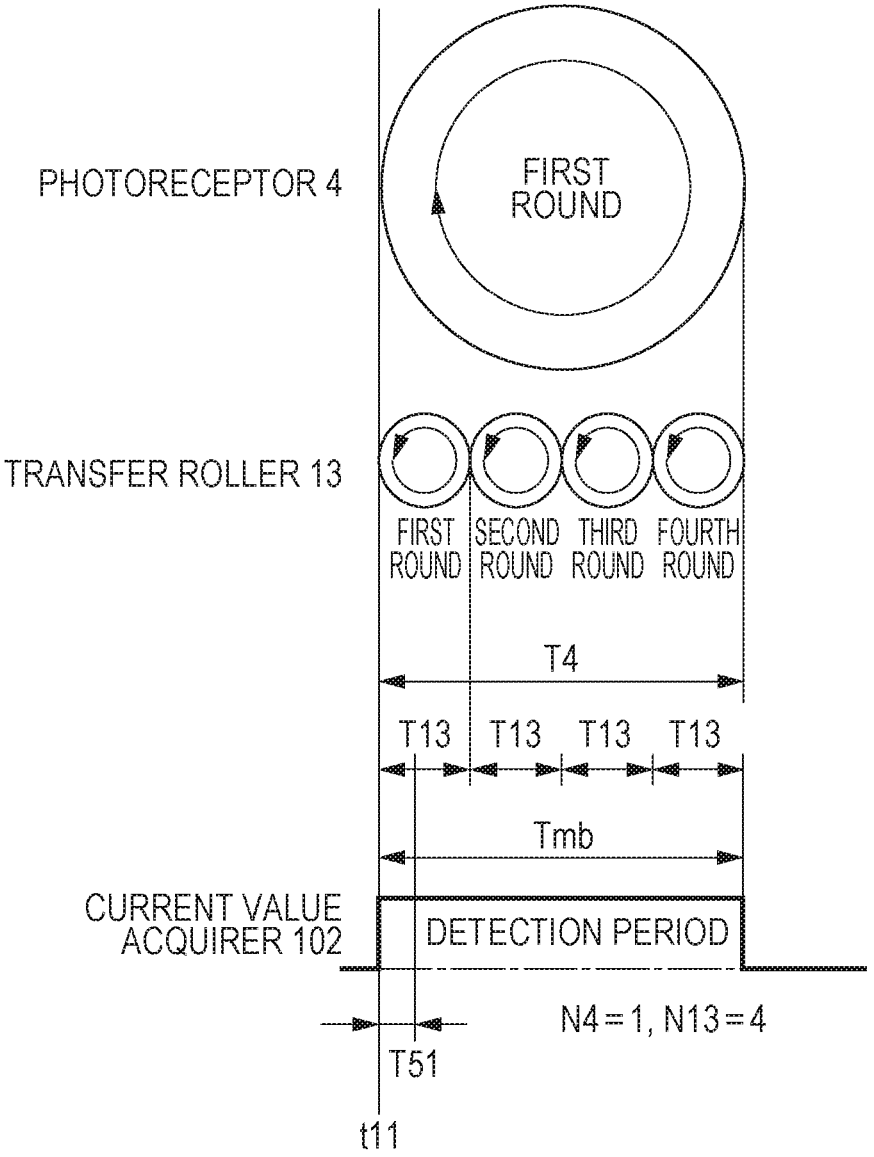
FIG. 12 is a view schematically illustrating a relationship between the detection period for acquiring the AC current value and the numbers of rotations of the photoreceptor and a transfer roller.

FIG. 11 illustrates an example of a configuration of a peripheral portion of a photoreceptor in another image forming device 2, and FIG. 12 schematically illustrates a relationship between a detection period Tmb for acquiring the AC current values DIh and the number of rotations of the photoreceptor 4 and a transfer roller 13.

In FIG. 11, the image forming device 2 includes the imaging unit 3 illustrated in FIG. 2. A difference between the image forming device 2 and the image forming device 1 described above is that the image forming device 2 does not include the intermediate transfer belt 12 and is configured to directly transfer the toner image from the photoreceptor 4 to the sheet P. Other configurations including the functional configuration of the control circuit 100 may be similar to those of the image forming device 1.

The image forming device 2 is provided with the transfer roller 13 and a high-voltage power supply circuit 33*b* for applying an AC bias V13 for transfer to the transfer roller 13. Just like the AC current detection circuit 31C illustrated in FIG. 4, the high-voltage power supply circuit 33*b* includes a circuit which outputs the AC current detection signal SIh.

The transfer roller 13 is movable in a radial direction of the photoreceptor 4 and is arranged so as to press the conveyed sheet P against the photoreceptor 4 at the time of transfer and to be separated from the photoreceptor 4 at the time of retraction. Also, when there is no sheet P, this may abut the photoreceptor 4.

In the image forming device 2, the transfer roller 13 may be used as the roller 50 for applying the AC bias Vm for detecting the state of the photoreceptor 4. In a case of using the transfer roller 13, a controller of the image forming device 2 controls the high-voltage power supply circuit 33*b* as a power supply which applies the AC bias Vm. The state detection of the photoreceptor 4 is performed when there is no sheet P between the photoreceptor 4 and the transfer roller 13, for example, at the time of standby when the input of the print job is waited, or before the conveyance of the sheet P is started in the print job.

In FIG. 12, the peripheral length of the photoreceptor 4 is selected to be four times a peripheral length of the transfer roller 13. In other words, the peripheral length of the transfer roller 13 is selected to be one-quarter of the peripheral length of the photoreceptor 4.

Therefore, the detection period Tmb is set to be a time period which is one time of the time T4 in which the photoreceptor 4 rotates once and also is four times a time T13 in which the transfer roller 13 rotates once. That is, a length of the detection period Tmb is the shortest of lengths at which both the number of rotations (N4) of the photoreceptor 4 and the number of rotations (N13) of the transfer roller 13 from a start timing t11 of the detection period Tmb are integers. As a result, it is possible to acquire the average current value AIh in which the effect of the variation of the AC current values DIh caused by the transfer roller 13 is suppressed.

Figure 13:
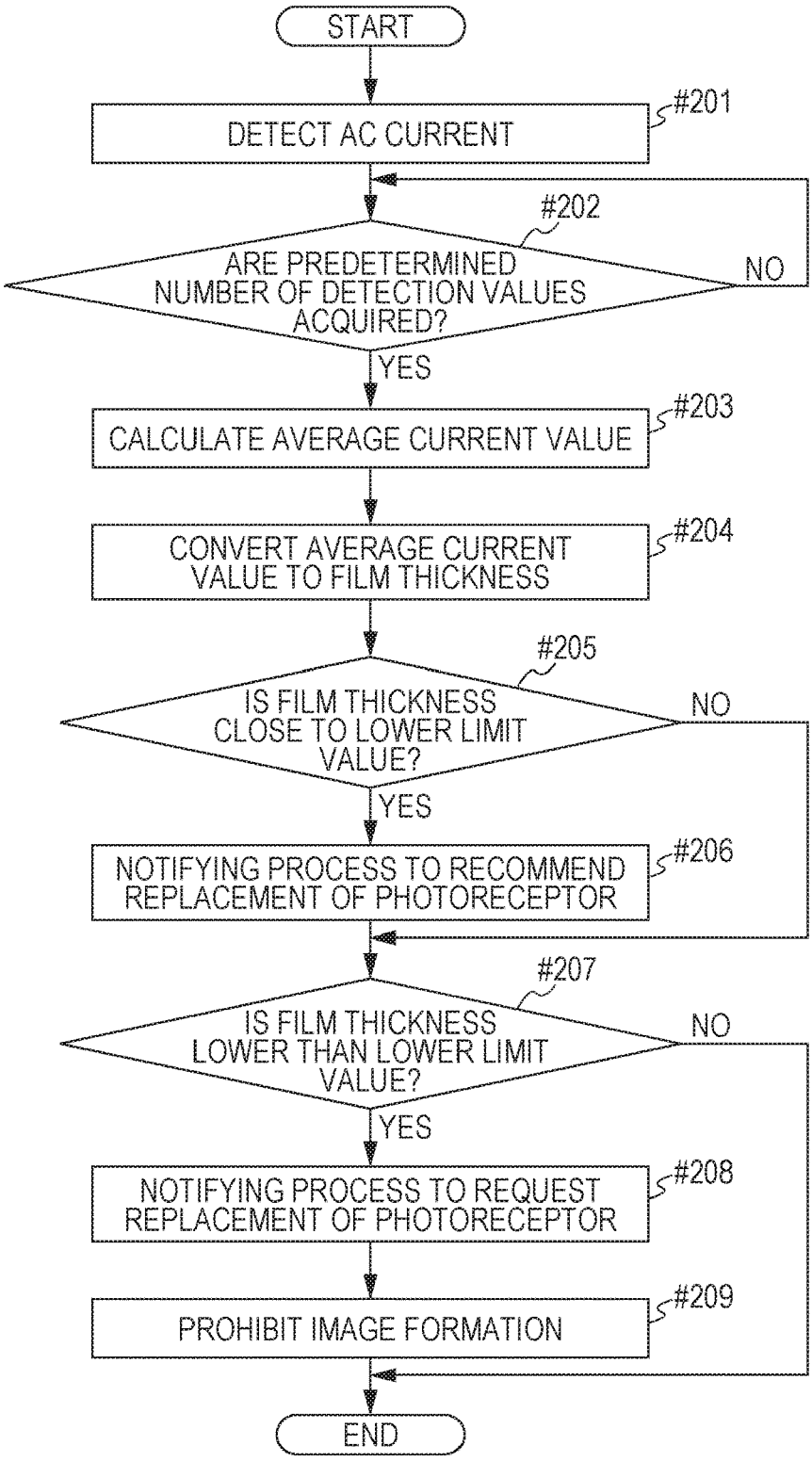
FIG. 13 is a view illustrating a flow of a process of detecting a state of the photoreceptor in the image forming device.

FIG. 13 illustrates a flow of a process of detecting the state of the photoreceptor 4 in the image forming device 1 or 2.

The AC bias Vm is applied to the roller 50 to detect the AC current Ih (#201). When acquiring the predetermined number of AC current values DIh determined by the lengths of the detection period Tm or Tmb and the cycle T51 (YES at #202), the average current value ADIh is calculated on the basis of a plurality of acquired AC current values DIh (#203).

Subsequently, the average current value ADIh is converted to the film thickness H using a predetermined arithmetic expression or conversion table (#204). However, it is not always necessary to convert to the film thickness H, and the state of the photoreceptor 4 may be evaluated by the average current value ADIh.

In a case where the film thickness H is a value close to the lower limit value (for example, a value corresponding to 25 to 15% of an initial film thickness H) (YES at #205), the notifying process of recommending the user to replace the photoreceptor 4 is performed (#206).

In a case where the film thickness H is equal to or lower than the lower limit value (for example, a value corresponding to 15% or less of the initial film thickness H) (YES at #207), the notifying process of requesting the replacement of the photoreceptor 4 is performed (#208), and the image formation is prohibited (#209).

According to the above-described embodiment, it is possible to acquire the average current value AIh which is less affected by the variation of the AC current values DIh caused by the roller 50 used for detecting the state of the photoreceptor 4 as compared to the conventional case, so that it is possible to improve reliability of the state detection of the photoreceptor 4 performed while the roller 50 abuts.

In the embodiment described above, it is possible to apply constant current between the roller 50 and the photoreceptor 4 over the detection period Tm or Tmb, detect voltage corresponding to the film thickness H every cycle T51, and detect the state of the photoreceptor 4 on the basis of the average value of the plurality of acquired voltage values.

In the embodiment described above, the length of the detection period Tm or Tmb is set to be the shortest of the lengths at which both the numbers of rotations of the photoreceptor 4 and the roller 50 are integers, but there is no limitation. In a case of detecting the state of the photoreceptor 4 when there is no possibility of impairing productivity of image formation as in standby mode, the length may be an integral multiple of the length at which both the numbers of rotations are integers. Also, the length of the detection period Tm or Tmb may be substantially a length at which both the numbers of rotations are integers.

In addition, the configuration of the entire or a part of the image forming device 1 or 2, contents, order, or a timing of the process, the time T4, the cycle T51 and the like may be appropriately changed in accordance with the spirit of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming device that forms a latent image on a rotating cylindrical image carrier, comprising:

a conductive roller that abuts the image carrier to rotate;

a power supply circuit that applies voltage to the roller;

a controller that controls the power supply circuit so as to apply the voltage to the roller over a predetermined detection period in a state in which the image carrier and the roller are rotated;

a detection value acquirer that acquires a detection value acquired by the application of the voltage indicating a state of the image carrier every cycle shorter than a time in which the roller rotates once in the detection period; and a state detector that detects a state of the image carrier on the basis of a plurality of acquired detection values, wherein a length of the detection period is set to a length at which both the numbers of rotations of the image carrier and the roller from a start of the detection period are integers.

2. The image forming device according to claim 1, wherein the state detector detects a state of wear of a surface layer of the image carrier or a state of covering by deposit on a peripheral surface of the image carrier as the state of the image carrier.

3. The image forming device according to claim 1, wherein the power supply circuit applies AC voltage of a level at which discharging does not occur between the roller and the image carrier to the roller as the voltage, and the detection value acquirer acquires a current value of an alternating component of current flowing between the roller and the image carrier as the detection value.

4. The image forming device according to claim 1, wherein the state detector calculates an average value of the plurality of acquired detection values as a detection result of the state of the image carrier.

5. The image forming device according to claim 1, comprising:

a charging roller that charges the image carrier, and a cleaning roller that cleans a peripheral surface of the image carrier, wherein the roller is the charging roller or the cleaning roller.

6. The image forming device according to claim 1, comprising:

a developer that visualizes the latent image as a toner image; and a transfer roller for applying transfer voltage to the image carrier when transferring the toner image to a member to be transferred, wherein the roller is the transfer roller.

7. The image forming device according to claim 1, wherein a peripheral length of the roller is selected to be an integer fraction of a peripheral length of the image carrier.

8. The image forming device according to claim 1, comprising:

a determiner that determines whether replacement of the image carrier is necessary on the basis of the detected state of the image carrier; and a notifier that, in a case where it is determined that the replacement is required, notifies the fact.

* * * * *